United States Patent [19]

Sugiura et al.

[11] Patent Number: 4,907,790

[45] Date of Patent: Mar. 13, 1990

[54] PELLET-LIFTING APPARATUS

[75] Inventors: Kazuo Sugiura, Hachioji; Takashi Takeuchi, Higashiyamato, both of Japan

[73] Assignee: Kabushiki Kaisha Shinkawa, Tokyo, Japan

[21] Appl. No.: 284,133

[22] Filed: Dec. 14, 1988

[30] Foreign Application Priority Data

Dec. 15, 1987 [JP] Japan ..... 62-315166

[51] Int. Cl.[4] ..... B25B 11/00

[52] U.S. Cl. ..... 269/21; 269/301; 279/3

[58] Field of Search ..... 414/609, 687, 785, 222, 414/227, 217; 269/21, 889 R, 296, 300, 301, 297, 298, 299, 292; 198/468.4, 470.1, 482.1; 279/1 E, 3

[56] References Cited

U.S. PATENT DOCUMENTS

| | | | |
|---|---|---|---|
| 1,544,107 | 6/1925 | Sharples | 269/301 |
| 2,982,558 | 5/1961 | Multer | 279/1 E |
| 3,938,789 | 2/1976 | Solie et al. | 269/296 X |
| 4,509,891 | 4/1985 | Lipslomb | 198/468.4 |

FOREIGN PATENT DOCUMENTS

| | | | |
|---|---|---|---|
| 62-98638 | 5/1987 | Japan | 269/21 |
| 0917945 | 4/1982 | U.S.S.R. | 279/1 E |

*Primary Examiner*—Robert J. Spar
*Assistant Examiner*—James R. Bidwell
*Attorney, Agent, or Firm*—Koda & Androlia

[57] ABSTRACT

An apparatus for lifting a pellet which is on a wafer sheet including a pin holder having a plurality of peripheral pin insertion holes formed in an X pattern. The pin holder also has V-shaped cut-out areas in the left and right sides surrounded by the X pattern, and the pin holder is driven up and down by a vertical drive. The pellet-lifting apparatus further includes peripheral lifting pins inserted into the peripheral pin insertion holes, and V-shaped bridges fastened to the pin holder so that the peripheral lifting pins are held between inner surfaces of the cut-out areas in the pin holder. With such a structure, peripheral lifting pins are set in the peripheral pin insertion holes of the pin holder so that the pins meet different sizes of pellets and lift them in a stable manner.

2 Claims, 4 Drawing Sheets

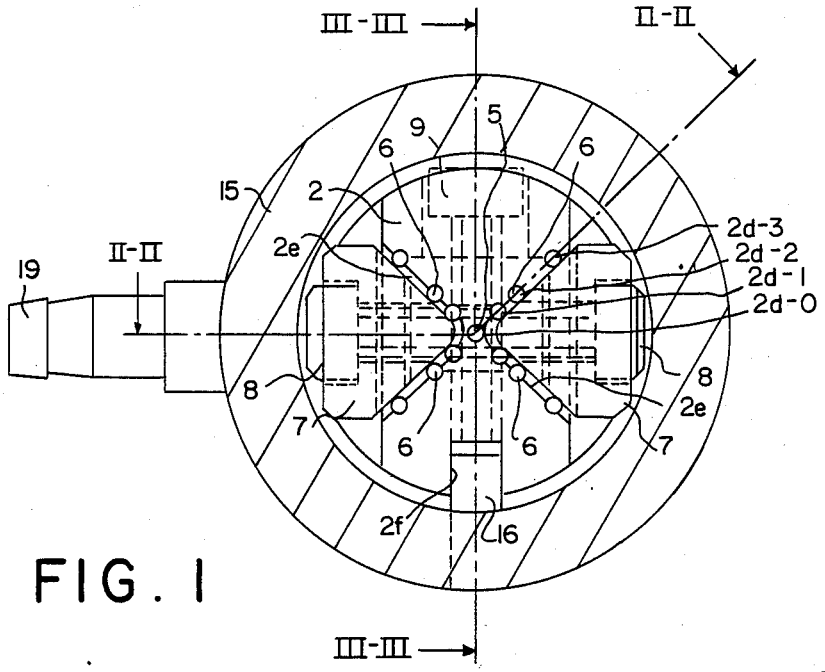
FIG. 1
FIG. 5a
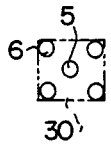
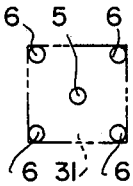
FIG. 5b
FIG. 5c
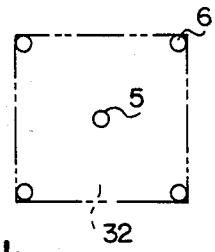
FIG. 5d
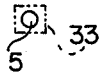

FIG. 4a
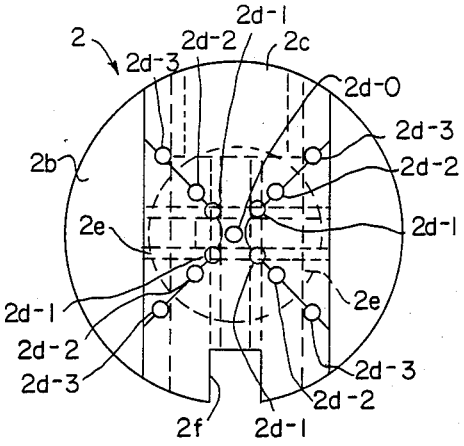
FIG. 4b
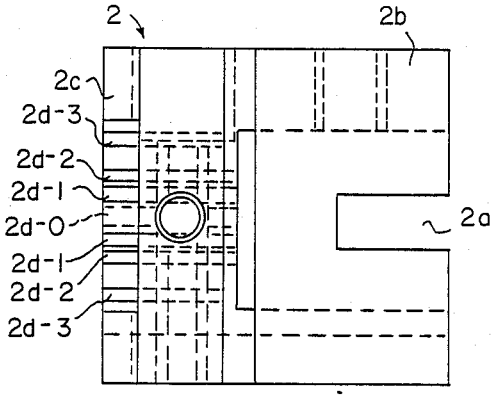
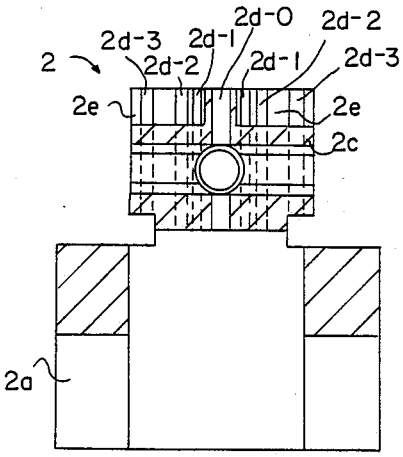
FIG. 4c

PELLET-LIFTING APPARATUS

BACKGROUND OF THE INVENTION

1. Field of the Invention

The present invention relates to a pellet-lifting apparatus which lifts pellets by means of lifting pins when the pellets located on a wafer sheet are picked up by a suction-adhesion nozzle.

2. Prior Art

In the past, an apparatus using a multiple number of peripheral lifting pins as described, for example, in Japanese Patent Application Laid-Open No. 62-98638, has been known as a means of lifting pellets in a stable manner.

In this apparatus, any change in the size of the pellets to be lifted necessitates a corresponding alteration in the arrangement and positioning of the peripheral lifting pins so that the pins will lift the pellets at the peripheral portions thereof. However, no consideration has been given to this point in prior art apparatuses.

In the abovementioned conventional apparatus, the peripheral lifting pins are inserted into peripheral pin insertion holes formed at prescribed positions in a pin holder to which the peripheral lifting pins are fastened. Then the peripheral lifting pins are fastened in place by screws. Accordingly, it is necessary to prepare a multiple number of pin holders so that the number of the holders corresponds to the number of different sizes of pellets that are to be handled. Furthermore, in cases where the central or peripheral lifting pins are broken for some reason, it is difficult to replace the pins.

Furthermore, the size of pin holders used for large pellets is often limited by the size of the surrounding parts. Moreover, since the peripheral lifting pins are positioned around the periphery of the pin holder, the screw holes, into which the screws for fastening the peripheral lifting pins are screwed, must be formed on the circumferential surface of the pin holder at points as far as possible from the peripheral pin insertion holes. In addition, the screw holes must be formed so that they do not intersect with each other. Thus, the pin fastening structure is extremely complicated.

In addition, the screws for fastening the peripheral lifting pins are usually small due to structural limitations inherent in the abovementioned pin holder. Thus, the tightening force of the screws is weak, which causes the peripheral lifting pins to fall out due to loosening of the screws.

SUMMARY OF THE INVENTION

Accordingly, a primary object of the present invention is to provide a pellet-lifting apparatus which is able to handle pellets of a number of different sizes using a single pin holder.

Another object of the present invention is to provide a pellet-lifting apparatus in which the lifting pins can be easily replaced should the pins break, and in which the lifting pins can be firmly affixed to the pellet-lifting apparatus.

The abovementioned objects of the present invention are achieved by a unique structure wherein a pin holder has a plurality of peripheral pin insertion holes formed in an X pattern as viewed from above. The pin holder also has V-shaped cut-out areas in the left and right sides surrounded by portions of the X pattern, and the pin holder is driven upward and downward by a vertical driving means. The pellet-lifting apparatus further includes peripheral lifting pins which are inserted into the peripheral pin insertion holes, and V-shaped bridges which are fastened to the pin holder so that the peripheral lifting pins are pressed against the inside surfaces of the cut-out areas in the pin holder.

With the above-described structure of the lifting apparatus, when the pellet size changes, or in cases where the peripheral lifting pins are broken, the bridges are loosened, and peripheral lifting pins are inserted into the peripheral pin insertion holes of the pin holder which meet the required size of the pellets. Then, when the bridges are subsequently tightened, the peripheral lifting pins are fastened to the pin holder so that the apparatus is ready to use.

BRIEF DESCRIPTION OF THE DRAWINGS

FIG. 1 is a partially cross-sectional plan view which illustrates one embodiment of the pellet-lifting apparatus of the present invention;

FIG. 4(*a*) is a plan view of the pin holder of the present invention, FIG. 4(*b*) is a right side view thereof, and FIG. 4(*c*) is a cross-sectional view thereof;

FIGS. 5(*a*) through 5(*d*) are explanatory plan views which illustrate fastening of peripheral lifting pins to meet the requirements of different pellet sizes.

DETAILED DESCRIPTION OF THE INVENTION

An embodiment of the present invention is described with reference to the attached drawings below.

Figure 2:
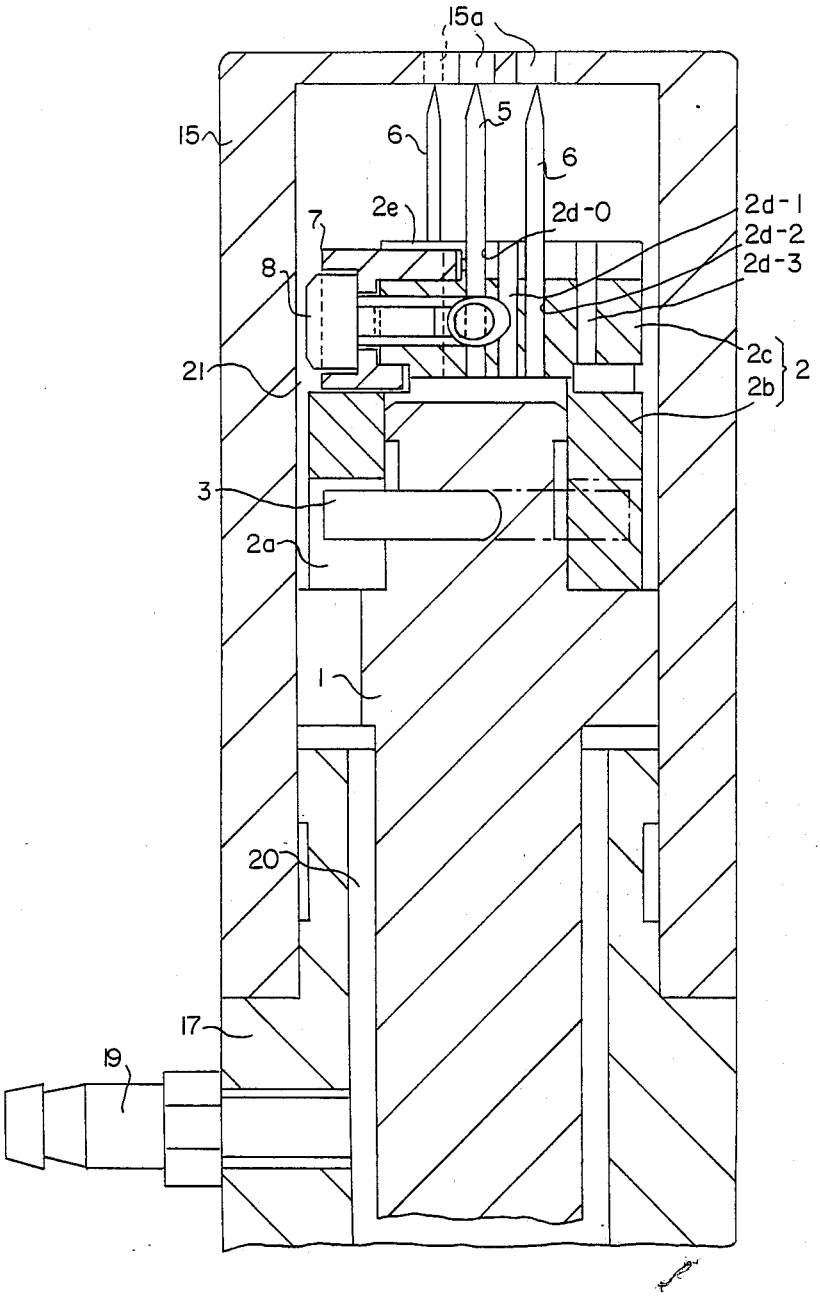
FIG. 2 is a cross-sectional view taken along line II—II in FIG. 1.
Figure 3:
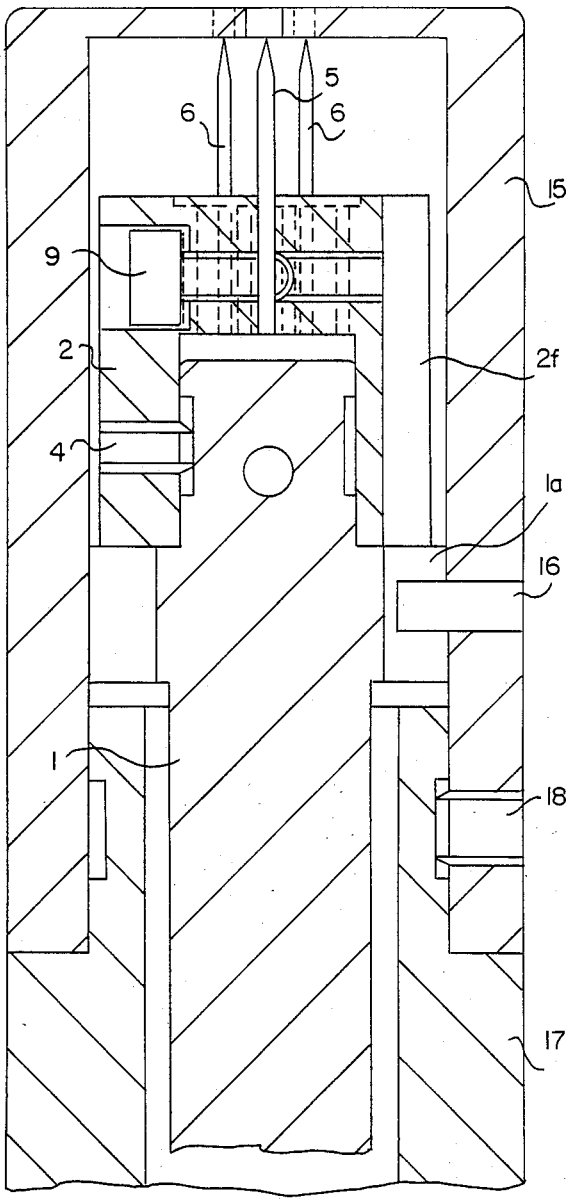
FIG. 3 is a cross-sectional view taken along line III—III in FIG. 1.

As is shown in FIGS. 1 through 3, a pin holder 2 is detachably mounted on the head of a pin holder driving shaft 1 which is driven upward and downward by a vertical driving means (not shown in the Figures). A positioning pin 3 which projects on both sides of the pin holder driving shaft 1 is fastened to the pin holder driving shaft 1 in order to set the direction of rotation of the pin holder 2 with respect to the pin holder driving shaft 1. Grooves 2*a* into which the positioning pin 3 is inserted are formed in the pin holder 2, and the pin holder 2 is fastened to the pin holder driving shaft 1 via a screw 4.

As is shown in FIG. 4, the pin holder 2 has a pin mounting part 2*c* on top of a shaft mounting part 2*b* which is mounted on the pin holder driving shaft 1. A central pin insertion hole of the pin mounting part 2*d*-0 passes vertically through the central portion of the pin mounting part 2 from the top surface thereof. Multiple numbers of first-rank, second-rank and third-rank peripheral pin insertion holes 2*d*-1, 2*d*-2, and 2*d*-3 which pass vertically through the pin mounting part 2 from the top surface thereof are formed at positions equal in distance from the central pin insertion hole 2*d*-0 on lines which extend in an X pattern from the central pin insertion hole 2*d*-0 (the latter forming the intersection of the "X"). Specifically, along the X-form pattern four first-rank peripheral pin insertion holes 2*d*-1, four second-rank holes 2*d*-2 and four third-rank holes 2*d*-3 are opened. Furthermore, cut-out areas 2*e* which are cut out in a V shape so that the area in the vicinity of the central pin insertion hole 2*d*-0 is left are formed facing each other in the left and right top-surface areas surrounded by the X-form lines connecting the central pin insertion hole 2*d*-0 and the peripheral pin insertion holes 2*d*-1, 2*d*-2 and 2*d*-3.

Returning to FIGS. 1 through 3, as the Figures indicate, a central lifting pin 5 and peripheral lifting pins 6 are inserted into the central pin insertion hole 2*d*-0 and the four second-rank peripheral pin insertion holes 2*d*-2, respectively. Furthermore, V-shaped bridges 7 whose side wall surfaces conform to the inside wall surfaces of the left and right cut-out areas 2*e* of the pin holder 2 are respectively installed in the cut-out areas 2*e*. These bridges 7 are fastened to the pin holder 2 by means of screws 8, so that the peripheral lifting pins 6 are pressed against the pin holder 2 by the bridges 7. The central lifting pin 5 is directly fastened to the pin holder 2 by a screw 9 which is screwed into the pin holder 2.

The pin holder driving shaft , pin holder 2, central lifting pin 5 and peripheral lifting pins 6 are accommodated inside a cup-shaped suction-adhesion stage 15. Suction-adhesion holes 15*a*, which also act as exit holes for the central lifting pin and peripheral lifting pins 6, are formed in the top of the suction-adhesion stage 15 so that the suction-adhesion holes 15 are positioned corresponding to the central lifting pin 5 and peripheral lifting pins 6. Furthermore, a guide pin 16 is fastened to the suction-adhesion stage 15 for the purpose of positioning the suction-adhesion holes 15*a* of the stage 15 in positions corresponding to the central lifting pin 5 and peripheral lifting pins 6. This guide pin 16 is inserted into vertical grooves 2*f* and 1*a* which are formed in the side surfaces of the pin holder 2 and pin holder driving shaft 1, respectively. The vertical grooves 2*f* and 1*a* connect with each other vertically, with the groove 2*f* running from the top surface of the pin holder 2. The suction-adhesion stage 16 is fastened via a screw 18 to a stage holder/driving cylinder 17 which is driven upward and downward by a driving means (not shown in the Figures).

Furthermore, a coupler 19 which is connected to a vacuum pump (not shown in the Figures) is provided at the stage holder/driving cylinder 17. Thus, vacuum pressure reaches the suction-adhesion holes 15*a* via the gap 20 between the stage holder/driving cylinder 17 and the pin holder driving shaft 1, and the gap 21 between the suction-adhesion stage 15 on the one hand and the pin holder driving shaft 1 and the pin holder 2 on the other hand.

Next, the operation of this embodiment will be described.

Since the central lifting pin 5, peripheral lifting pins 6 and suction-adhesion stage 15 operate in the same manner as in a conventional apparatus, their description may be simplified. When the pin holder driving shaft 1 is raised with a wafer sheet (not shown in the Figures) adhered by suction to the suction-adhesion stage 15, the pin holder 2 rises. Thus, the central lifting pin 5 and peripheral lifting pins 6 also rise upward through the suction-adhesion holes 15*a* of the suction-adhesion stage 15. As a result, a pellet (not shown in the Figures) which is adhered to the wafer sheet is lifted upward, and this pellet is picked up by a suction-adhesion nozzle (not shown in the Figures). Afterward, the pin holder driving shaft 1 is lowered, which causes the central lifting pin 5 and peripheral lifting pins 6 to be lowered. Then, the vacuum pressure holding the wafer sheet on the suction-adhesion stage 15 is switched "off."

In the embodiment illustrated in the Figures, a central lifting pin 5 and peripheral lifting pins 6 are installed in the central pin insertion hole 2*d*-0 and peripheral pin insertion holes 2*d*-2, respectively. This arrangement is suitable for lifting a pellet 31 of the size shown in FIG. 5(*b*). In order to lift a pellet 30 of the size shown in FIG. 5(*a*), it is only necessary to set the peripheral lifting pins 6 in the peripheral pin insertion holes 2*d*-1 (instead of the peripheral pin insertion holes 2*d*-2). Furthermore, the apparatus can similarly be adjusted for a pellet 32 of the size shown in FIG. 5(*c*) by setting peripheral lifting pins in the peripheral pin insertion holes 2*d*-3.

The setting of peripheral lifting pins 6 in order to adjust the apparatus for various different pellet sizes, such as pellets 30, 31 and 32, can be simply accomplished. More specifically, the screws 8 are first loosened, and the bridges 7 are withdrawn from their positions. The peripheral lifting pins 6 are then inserted into the peripheral pin insertion holes 2*d*-1, 2*d*-2 or 2*d*-3 according to the size of the pellet 30, 31 or 32, and the screws 8 are tightened. In this case, it is also necessary to replace the suction-adhesion stage 15 with another suction-adhesion stage 15 which has suction-adhesion holes 15*a* formed in positions corresponding to the positions of the peripheral lifting pins 6 inserted into the peripheral pin insertion holes 2*d*-1, 2*d*-2 or 2*d*-3.

FIG. 5(*d*) illustrates a case wherein only the central lifting pin is used for an extremely small pellet 33. In the cases illustrated in FIG. 5(*a*) through 5(*c*), though the central lifting pin 5 is used together with the peripheral lifting pins 6 in the operation described above, it is possible to use only the peripheral lifting pins 6.

Furthermore, since the peripheral lifting pins are pressed against the pin holder 2 by the bridges 7, the structure is simple, and the peripheral lifting pins 6 can be firmly fastened in place.

Since the apparatus of this invention is designed so that a guide pin 16 installed on the suction-adhesion stage 15 is inserted into the vertical grooves 2*f* and 1*a* formed in the pin holder 2 and the pin holder driving shaft 1, insertion of the guide pin 16 into the grooves 2*f* and 1*a* when the suction-adhesion stage 15 is mounted over the pin holder 2 will insure that the positions of the suction-adhesion holes 15*a* of the suction-adhesion stage 15 correspond to the positions of the peripheral lifting pins 6. Accordingly, the central lifting pin 5 or peripheral lifting pins 6 do not become blunt as a result of their tips striking the suction-adhesion stage 15 when the suction-adhesion stage 15 is mounted over the pin holder 2.

Furthermore, since the pin holder 2 is integrally fastened to the pin holder driving shaft 1 by means of a screw 4 so that the pin holder 2 moves up and down together with the pin holder driving shaft 1, it is also possible to form the pin holder 2 and the pin holder driving shaft 1 as a single integral part.

As is clear from the above description, according to the present invention it is possible to handle pellets of various different sizes with a single pin holder. Furthermore, even if the lifting pins should break, the pins can easily be replaced, and moreover, the lifting pins can be firmly fastened in place.

I claim:

1. A pellet-lifting apparatus characterized in that said apparatus comprises:

a pin holder which has a plurality of peripheral pin insertion holes formed in an X pattern when viewed from above, said pin holder having V-shaped cut-out areas in the left and right sides surrounded by said X pattern and driven up and down by a vertical driving means;

peripheral lifting pins inserted into said peripheral pin insertion holes; and

V-shaped bridges fastened to said pin holder so that said peripheral lifting pins are pressed against the inside surfaces of cut-out areas in said pin holder.

2. A pellet-lifting apparatus characterized in that said apparatus comprises:

a pin holder which is driven up and down by a vertical driving means and has a plurality of peripheral pin insertion holes formed in an X pattern when viewed from above, said pin holder having V-shaped cut-out areas in the left and right sides surrounded by said X pattern and a vertical groove running from the top to the bottom of said pin holder; and peripheral lifting pins inserted into said peripheral pin insertion holes, V-shaped bridges fastened to said pin holder so that said peripheral lifting pins are pressed against the inside surface of said cut-out areas of said pin holder; and a suction-adhesion stage which has suction-adhesion holes, which also act as through holes for said peripheral lifting pins, formed in its top surface and has a guide pin fastened thereto which is inserted into said vertical groove of said pin holder in order to position said stage in a position where said holes are aligned to said peripheral lifting pins, said suction-adhesion stage covering said pin holder.

* * * * *